US012767383B2

(12) United States Patent
Lo

(10) Patent No.: US 12,767,383 B2
(45) Date of Patent: Oct. 20, 2026

(54) RESILIENT CARDBOARD CUSHION

(71) Applicants: YFYJUPITER US, INC., Cook, IL (US); YFY JUPITER LIMITED, HONG KONG (HK)

(72) Inventor: Chih-Ling Lo, Taoyuan City (TW)

(73) Assignees: YFYJUPITER US, INC., Cook, IL (US); YFY JUPITER LIMITED, Hong Kong (HK)

( * ) Notice: Subject to any disclaimer, the term of this patent is extended or adjusted under 35 U.S.C. 154(b) by 0 days.

(21) Appl. No.: 19/190,819

(22) Filed: Apr. 28, 2025

(65) Prior Publication Data

US 2026/0116616 A1 Apr. 30, 2026

Related U.S. Application Data

(60) Provisional application No. 63/713,585, filed on Oct. 30, 2024.

(51) Int. Cl.
*B65D 5/50* (2006.01)
*B65D 81/05* (2006.01)

(52) U.S. Cl.
CPC ..... *B65D 5/505* (2013.01); *B65D 5/5035* (2013.01); *B65D 81/05* (2013.01); *B65D 2581/053* (2013.01)

(58) Field of Classification Search
CPC .. B65D 5/505; B65D 2581/053; B65D 81/05; B65D 5/5035
USPC ..... 206/591; 220/629, 630, 632, 651
See application file for complete search history.

(56) References Cited

U.S. PATENT DOCUMENTS

| | | | | |
|---|---|---|---|---|
| 5,486,078 | A * | 1/1996 | Wise | B63B 25/24 410/154 |
| 5,855,459 | A * | 1/1999 | Krier | B60P 7/135 410/121 |
| 8,025,179 | B2 * | 9/2011 | Miller | B65D 77/0433 206/45.24 |
| 11,820,562 | B2 | 11/2023 | Fernandez et al. | |
| 2022/0380107 | A1 | 12/2022 | Corrigan et al. | |

FOREIGN PATENT DOCUMENTS

| | | | |
|---|---|---|---|
| CN | 104159825 | A | 11/2014 |
| JP | 2002012270 | A | 1/2002 |
| JP | 2010036925 | A | 2/2010 |
| TW | M362203 | U | 8/2009 |

OTHER PUBLICATIONS

Freedom to Operate Report against U.S. Pat. No. 11,820,562 B2, Oct. 18, 2024, 58 pages.

* cited by examiner

*Primary Examiner* — Nathan J Jenness
*Assistant Examiner* — Jennifer Castriotta
(74) *Attorney, Agent, or Firm* — CKC & Partners Co., LLC

(57) ABSTRACT

A resilient cardboard cushion includes a top supporting board, a folded cardboard spring, a bottom supporting board, and a slidable supporting foot. The folded cardboard spring is connected to a first side of the top supporting board, the bottom supporting board is connected to the folded cardboard spring, and the slidable supporting foot is connected to a second side of the top supporting board and is configured to be slidably engaged with the bottom supporting board.

17 Claims, 6 Drawing Sheets

RESILIENT CARDBOARD CUSHION

RELATED APPLICATIONS

This application claims priority to U.S. Provisional Application Ser. No. 63/713,585, filed Oct. 30, 2024, the disclosures of which are incorporated herein by reference in their entireties.

BACKGROUND

Technical Field

The present disclosure relates to a resilient cardboard cushion. More particularly, the present disclosure relates to a resilient cardboard cushion for packaging.

Description of Related Art

In recent years, the rapid advancement of science and technology has led to the widespread adoption of various electronic products, which have gradually become essential tools in consumers' daily lives.

General electronic products, especially those with display screens—such as LCD TVs, monitors, mobile phones, display cards, or other electronic products—are typically packaged in cartons or boxes before shipment. In addition, cushioning packaging materials are placed around the electronic products and inside the boxes, wrapping them in a large-area direct contact manner to reduce damage during transportation.

However, with the growing awareness of environmental protection, many countries around the world now require cushioning packaging materials to be made from biodegradable materials. In addition, as the demand for the safety and reliability of electronic product transportation has increased in recent years, various types of cushioning packaging materials have been continuously developed.

Some manufacturers utilize folded corrugated paper to protect electronic products. However, this type of cushioning packaging materials still has issues such as complex assembly and insufficient shock absorption capability.

Hence, there is a need to provide a cushioning packaging material that is easy to manufacture and enhances shock-absorbing capabilities as this will help improve the safety and reliability of electronic product shipments while also reducing environment impact.

SUMMARY

The summary of the present invention is intended to provide a simplified description of the disclosure to enable readers to have a basic understanding of the disclosure. The summary of the present invention is not a complete overview of the disclosure, and it is not intended to point out the importance of the embodiments/key elements of the present invention or define the scope of the invention.

One objective of the embodiments of the present invention is to provide a cushion packaging material that enhances shock-absorbing capability while reducing environment impact.

To achieve these and other advantages and in accordance with the objective of the embodiments of the present invention, as the embodiment broadly describes herein, the present invention provides a resilient cardboard cushion including a top supporting board, a folded cardboard spring, a bottom supporting board, and a slidable supporting foot. The folded cardboard spring is connected to a first side of the top supporting board, the bottom supporting board is connected to the folded cardboard spring, and the slidable supporting foot is connected to a second side of the top supporting board and configured to be slidably engaged with the bottom supporting board.

In some embodiments, the first side of the top supporting board and the second side of the top supporting board form a first included angle, and the first included angle is about 90 degrees.

In some embodiments, the folded cardboard spring includes a first folded board and a second folded board. The first folded board is connected to the first side of the top supporting board, and the second folded board is connected between the first folded board and the bottom supporting board.

In some embodiments, the resilient cardboard cushion further includes a slidable protrusion bottom board connected to the slidable supporting foot.

In some embodiments, the bottom supporting board further includes a U-shaped opening, and the slidable supporting foot and the slidable protrusion bottom board are slidable in the U-shaped opening.

In some embodiments, the resilient cardboard cushion further includes another slidable protrusion bottom board, and the two slidable protrusion bottom board are configured to touch each other.

In some embodiments, a width of the slidable protrusion bottom board is greater than a width at a connection position between the slidable supporting foot and the slidable protrusion bottom board.

In some embodiments, the slidable supporting foot includes a first interference edge, and a second included angle forms between the first interference edge and the second side of the top supporting board. Furthermore, the first folded board includes a second interference edge, and a third included angle forms between the second interference edge and the first side of the top supporting board. In addition, a sum of the second included angle and the third included angle is greater than 90 degrees.

In some embodiments, the second included angle is 40.7 degrees to 50 degrees.

In some embodiments, the third included angle is 52 degrees to 62 degrees.

In some embodiments, the first interference edge is configured to touch the second interference edge to slow a compression of the resilient cardboard cushion.

In some embodiments, the resilient cardboard cushion further includes an opening located at a connection area of the top supporting board and the first folded board.

In some embodiments, the second folded board includes a third interference edge, and a fourth included angle forms between the third interference edge and the bottom supporting board. In addition, the fourth included angle is equal to the third included angle.

In some embodiments, the first interference edge is configured to touch the third interference edge to slow the compression of the resilient cardboard cushion.

In some embodiments, the resilient cardboard cushion further includes a circular opening formed in the top supporting board.

Hence, the resilient cardboard cushion of the present invention can effectively support electronic products stored in a packaging carton. Especially, during transportation, drop tests, or impact tests, the resilient cardboard cushion provides the necessary cushioning support to prevent damage to the electronic products, thereby enhancing their safety during transportation and storage.

BRIEF DESCRIPTION OF THE DRAWINGS

The disclosure can be more fully understood by reading the following detailed description of the embodiment, with reference made to the accompanying drawings as follows.

DETAILED DESCRIPTION OF THE PREFERRED EMBODIMENT

Figure 1:
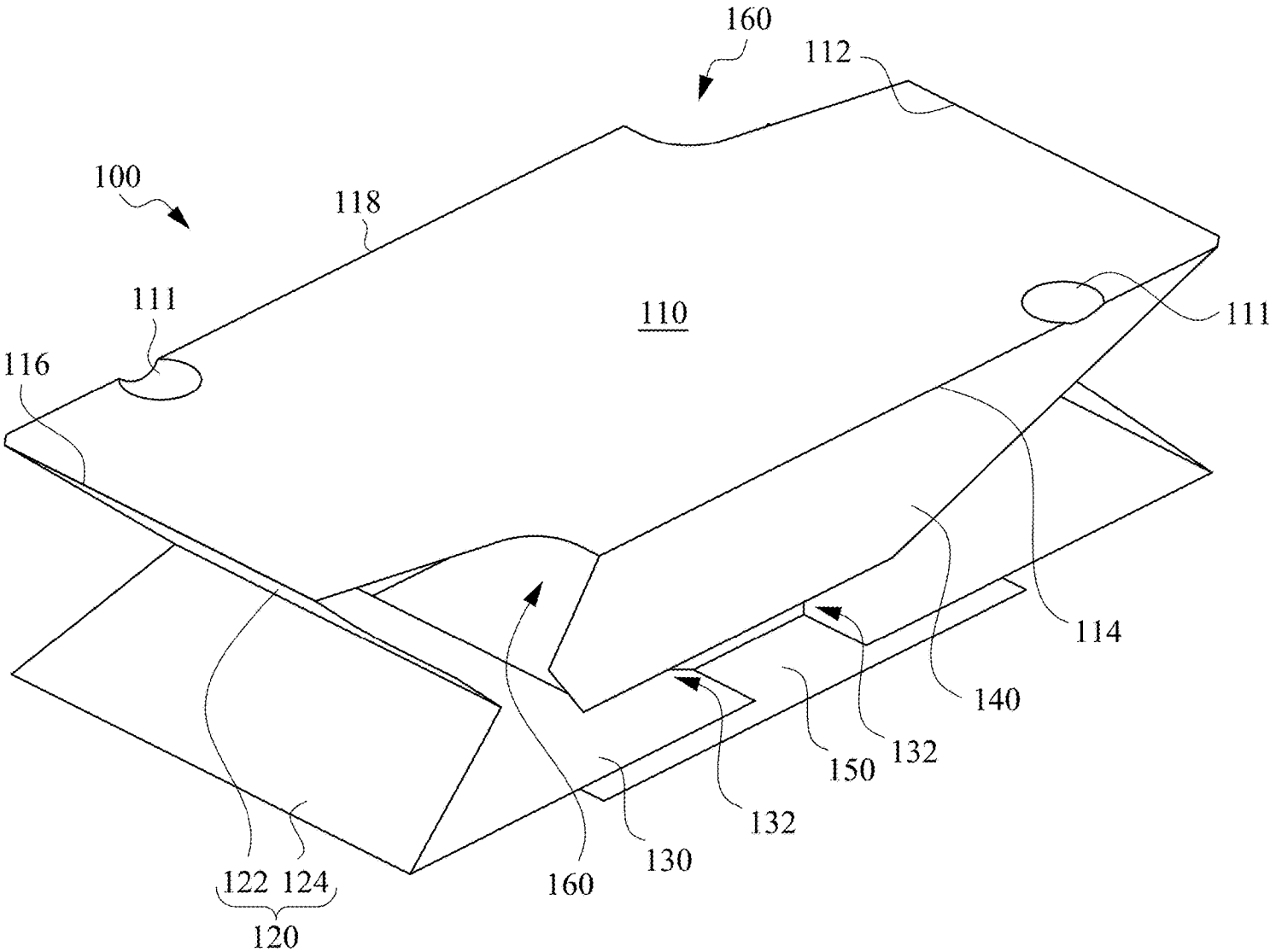
FIG. 1 illustrates a schematic perspective diagram showing a resilient cardboard cushion according to one embodiment of the present invention.

The following is a detailed description of the embodiments in conjunction with the accompanying drawings, but the provided embodiments are not intended to limit the scope of the disclosure, and the description of the structure and operation is not used to limit the execution sequence thereof. The structure of the recombination of components and the resulting devices with equal functions are all within the scope of this disclosure. In addition, the drawings are for illustration purposes only, and are not drawn according to the original scale. For ease of understanding, the same reference numbers are used in the drawings and the description to refer to the same or like parts.

In addition, the terms used in the entire description and the scope of the patent application, unless otherwise specified, usually have the usual meaning of each term used in this field, in the content disclosed here and in the special content. Some terms used to describe the disclosure are discussed below or elsewhere in this specification to provide additional guidance to those skilled in the art in the disclosure.

In the implementation mode and the scope of the present application, unless the article is specifically limited in the context, "a" and "the" can generally refer to a single or pluralities. In the steps, the numbering is only used to conveniently describe the steps, rather than to limit the sequence and implementation.

Secondly, the words "comprising", "including", "having", "containing" and the like used in the present application are all open language, meaning including but not limited to.

Figure 2:
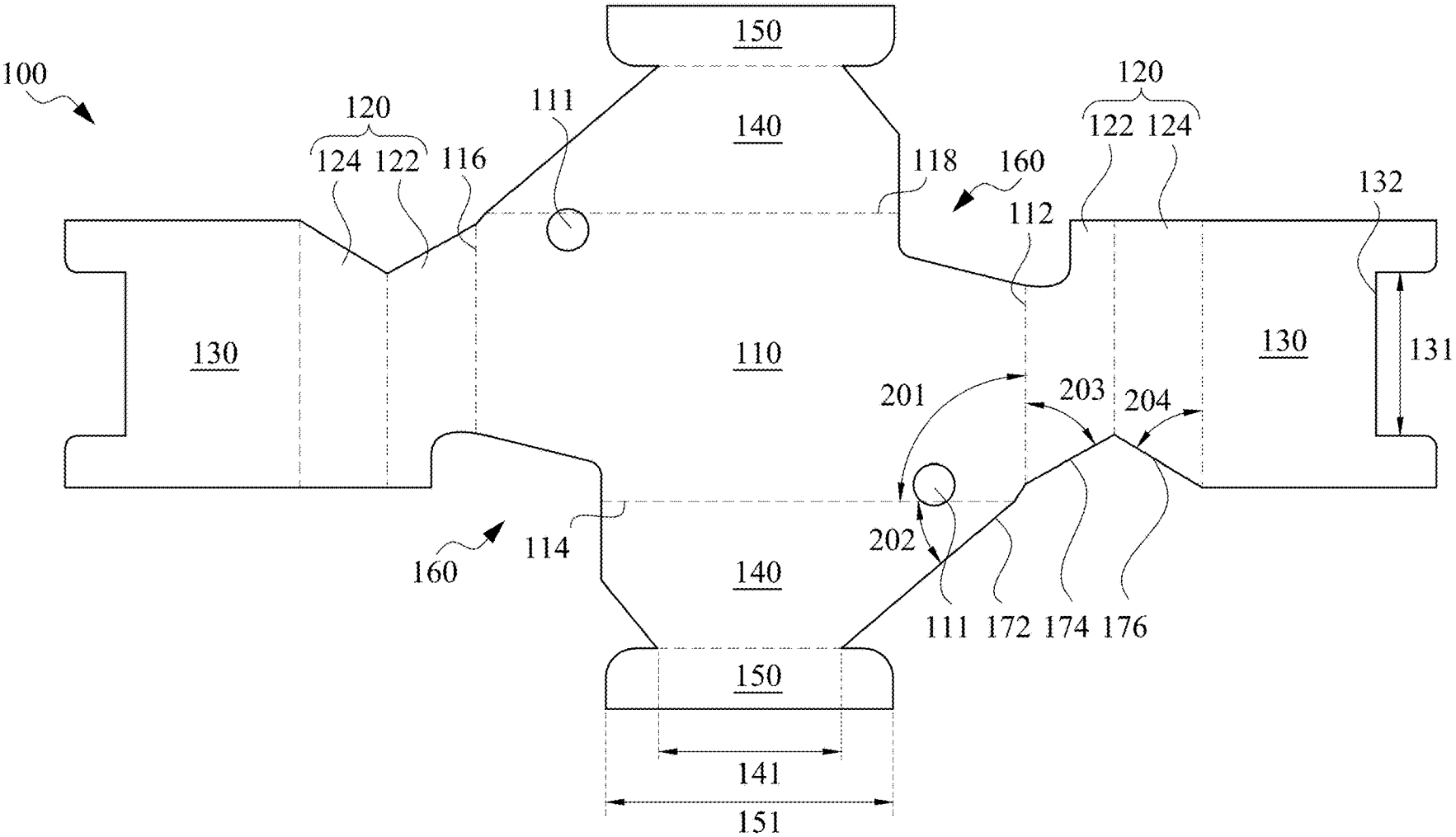
FIG. 2 illustrates a schematic plane expansion diagram of the resilient cardboard cushion according to one embodiment of the present invention.

Please first refer to FIG. 1 and FIG. 2. FIG. 1 is a schematic perspective diagram showing the resilient cardboard cushion according to one embodiment of the present invention, and FIG. 2 is a schematic plane expansion diagram thereof. As shown in the figures, the resilient cardboard cushion 100 includes a top supporting board 110, a folded cardboard spring 120, a bottom supporting board 130, and a slidable supporting foot 140. The top supporting board 110 includes a first side 112, a second side 114, a third side 116, and a fourth side 118. Preferably, the first side 112 and the third side 116 are formed symmetrically, and the second side 114 and the fourth side 118 are formed symmetrically.

The folded cardboard spring 120 is connected to the first side 112 of the top supporting board 110, and another folded cardboard spring 120 is connected to the third side 116 of the top supporting board 110. In addition, the bottom supporting board 130 is connected to the folded cardboard spring 120.

The slidable supporting foot 140 is connected to the second side 114 of the top supporting board 110, and another slidable supporting foot 140 is connected to the fourth side 118 of the top supporting board 110. The slidable supporting foot 140 is configured to be slidably engaged with the bottom supporting board 130. The first side 112 and the second side 114 form a first included angle 201, for example, the first included angle 201 is about 90 degrees. In some embodiments, the first side 112 is perpendicular to the second side 114, and the third side 116 is perpendicular to the fourth side 118. In addition, the first side 112 are symmetrical to the third side 116, and the second side 114 are symmetrical to the fourth side 118, but not limited thereto. The first included angle 201 may be greater than 90 degrees or smaller than 90 degrees, without departing from the spirit and scope of the disclosure.

In some embodiments, the folded cardboard spring 120 includes a first folded board 122 and a second folded board 124. The first folded board 122 is connected to the second folded board 124, and the first folded board 122 is connected to the first side 112 or the third side 116 of the top supporting board 110, and the second folded board 124 is connected between the first folded board 122 and the bottom supporting board 130.

Figure 3:
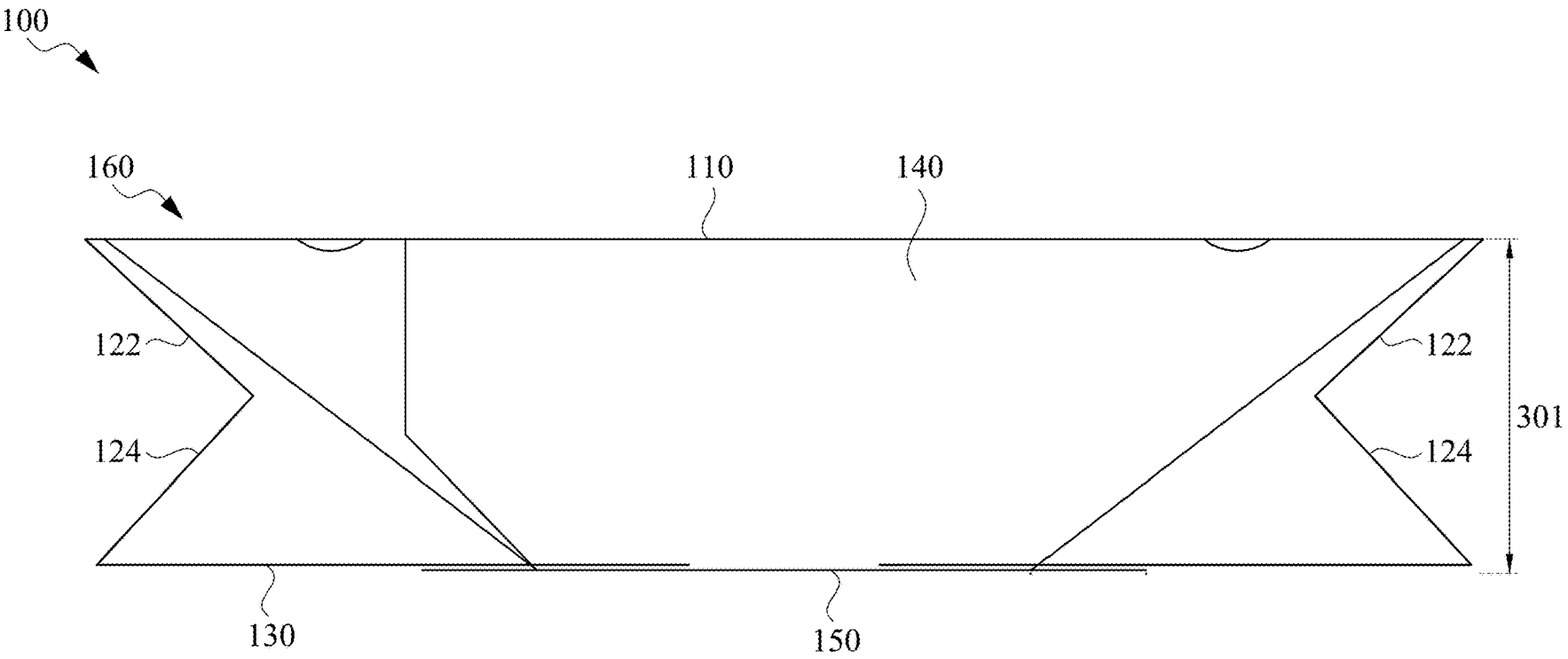
FIG. 3 illustrates a side view showing a resilient cardboard cushion according to one embodiment of the present invention.

In some embodiments, please refer to FIG. 3. FIG. 3 is a side view of the resilient cardboard cushion according to one embodiment of the present invention. As shown in the figure, the top supporting board 110, the first folded board 122, the second folded board 124, and the bottom supporting board 130 form an M-shaped elastic structure that provides an elastic force to the top supporting board 110 relative to the bottom supporting board 130, supporting the electronic product placed above the top supporting board 110. The M-shaped elastic structure thus improves the impact resistance of the electronic product when stored in the packaging carton. The height 301 is an original height of the resilient cardboard cushion 100 in its uncompressed state when not under stress.

Please further refer to FIG. 1 and FIG. 2 again. In some embodiments, the resilient cardboard cushion 100 further includes a slidable protrusion bottom board 150 connected to the slidable supporting foot 140. The width 151 of the slidable protrusion bottom board 150 is greater than the width 141 at the connection position between the slidable supporting foot 140 and the slidable protrusion bottom board 150.

Furthermore, in some embodiments, the bottom supporting board 130 further includes a U-shaped opening 132, and the slidable supporting foot 140 and the slidable protrusion bottom board 150 are slidable in the U-shaped opening 132. In addition, the U-shaped opening 132 includes a width 131, and the slidable supporting foot 140 and the slidable protrusion bottom board 150 are folded to clamp the edges of the of the U-shaped opening 132 and slides along the width 131 of the U-shaped opening 132.

Figure 4:
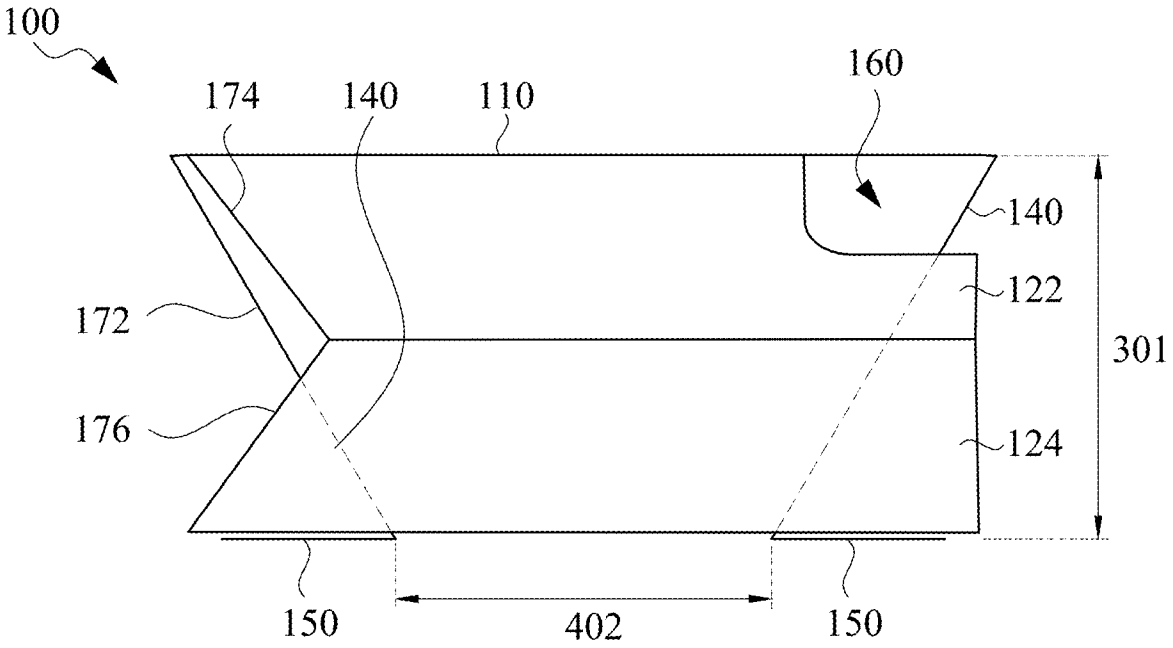
FIG. 4 illustrates a side view of a resilient cardboard cushion according to one embodiment of the present invention, shown from another view angle.

Please refer to FIG. 4. FIG. 4 is a side view from another view angle. The height 301 is the original height of the resilient cardboard cushion 100 in its uncompressed state when not under pressure. In addition, two slidable protrusion bottom boards 150 are spaced apart by a gap 402. The slidable supporting foot 140 forms an inclined support structure and the slidable protrusion bottom board 150 may slide at the bottom of the resilient cardboard cushion 100.

Figure 5:
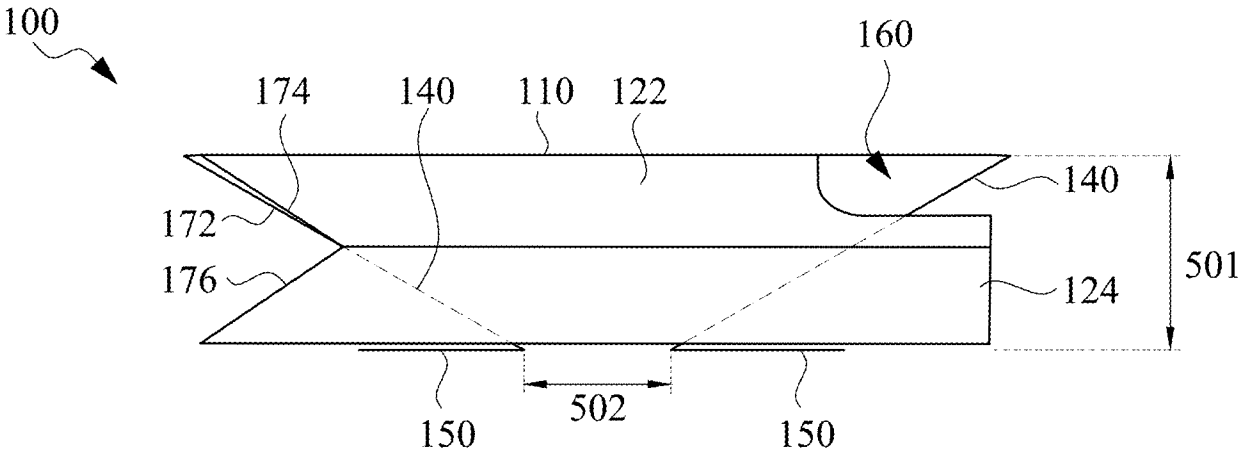
FIG. 5 illustrates a side view of a resilient cardboard cushion according to one embodiment of the present invention, shown from the same view angle as FIG. 4, but in a compressed state.

Please refer to FIG. 2, FIG. 4, and FIG. 5, with FIG. 5 showing a side view of the resilient cardboard cushion in a compressed state. In FIG. 2, the slidable supporting foot 140 includes a first interference edge 172, and a second included angle 202 forms between the first interference edge 172 and the second side 114 of the top supporting board 110. In addition, the first folded board 122 includes a second interference edge 174, and a third included angle 203 forms between the second interference edge 174 and the first side 112 of the top supporting board 110. Further, the second folded board 124 includes a third interference edge 176, and a fourth included angle 204 forms between the third interference edge 176 and the bottom supporting board 130. In some embodiments, the third interference edge 176 and the second interference edge 174 are symmetrically formed, and the fourth included angle 204 is approximately equal to the third included angle 203, but not limited thereto. In some embodiments, the fourth included angle 204 is equal to the third included angle 203.

In FIG. 4, when the resilient cardboard cushion 100 is not stressed, the height 301 of the resilient cardboard cushion 100 is the original height thereof, and the first interference edge 172 and the second interference edge 174 separate from each other without interfering with each other.

As shown in FIG. 5, in some embodiments, when the height of the resilient cardboard cushion 100 is compressed to the height 501, approximately half of the original height of the resilient cardboard cushion 100, the first interference edge 172 and the second interference edge 174 touch each other to slow down further compression of the resilient cardboard cushion 100. Meanwhile, the two slidable protrusion bottom boards 150 move closer to each other, with a gap 502 formed therebetween.

When the height of the resilient cardboard cushion 100 is compressed to approximately half of the original height, the first interference edge 172 may touch the third interference edge 176 to slow down further compression of the resilient cardboard cushion 100.

Please refer to FIG. 2. In some embodiments, the first included angle 201 is about 90 degrees, and the sum of the second included angle 202 and the third included angle 203 is greater than 90 degrees.

In some embodiments, the second included angle 202 is 40.7 degrees to 50 degrees, preferably 40.7 degrees to 45 degrees, and more preferably 40.7 degrees to 43 degrees.

In some embodiments, the third included angle 203 is 52 degrees to 62 degrees, preferably 57 degrees to 62 degrees, and more preferably 59 degrees to 62 degrees.

In some embodiments, the first included angle 201 is about 90 degrees, the second included angle 202 is about 40.82 degrees, and the third included angle 203 is about 61.82 degrees, but not limited thereto.

Figure 6:
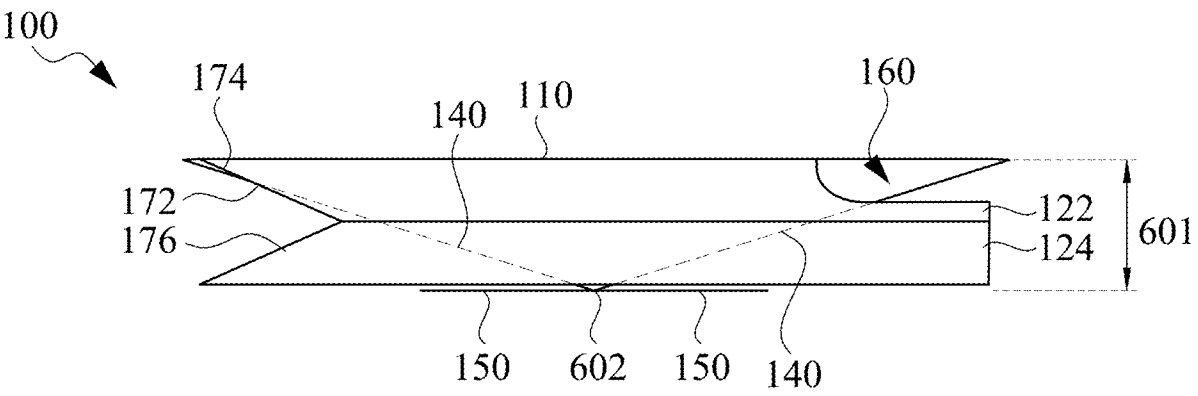
FIG. 6 illustrates a side view of a resilient cardboard cushion according to one embodiment of the present invention, shown from the same view angle as FIG. 5, but in a further compressed state.

Please refer to FIG. 6. FIG. 6 is a side view of the resilient cardboard cushion in a further compressed state. As shown in the figure, when the height of the resilient cardboard cushion 100 is compressed to the height 601, approximately one-third of the original height of the resilient cardboard cushion 100, e.g. from 45 mm to 15 mm, the two slidable protrusion bottom boards 150 touch each other at a contact point 602 to prevent the resilient cardboard cushion 100 from being further compressed. Therefore, full collapse to the bottom of the resilient cardboard cushion 100 can be effectively avoided, thereby providing greater support and elasticity for electronic products and preventing damage from impact.

In some embodiments, the resilient cardboard cushion 100 further includes an opening 160, which is located at the connection area of the top supporting board 110 and the first folded board 122. In some embodiments, the opening 160 may also accommodate a protruding part of an electronic product, without departing from the spirit and scope of the disclosure.

In some embodiments, the resilient cardboard cushion 100 further includes at least one circular opening 111, which is formed in the top supporting board 110 and positioned adjacent to the fourth side 118, the second side 114, or both.

In some embodiments, the resilient cardboard cushion 100 is made of any recycled cardboard or virgin cardboard, such as corrugated cardboard, cut with a die and then folded into shape, without departing from the spirit and protection of the present invention.

Accordingly, the resilient cardboard cushion according to the present invention can effectively support electronic products stored in a packaging carton. Especially when the electronic products are transported or subjected to a drop test or an impact test, the resilient cardboard cushion can provide the required cushioning support force so as to prevent the electronic products from being damaged, thereby improving the safety of the electronic products during transportation and storage.

Although the present disclosure has been disclosed above in terms of implementation, it is not intended to limit the present disclosure. Any person with ordinary knowledge in the field may make various variations and modifications without departing from the spirit and scope of the disclosure. Therefore, the spirit and scope of the appended claims should not be limited to the description of the embodiments contained herein.

What is claimed is:

1. A resilient cardboard cushion, comprising:

a top supporting board;

a folded cardboard spring connected to a first side of the top supporting board;

a bottom supporting board connected to the folded cardboard spring; and a slidable supporting foot connected to a second side of the top supporting board and configured to be slidably engaged with the bottom supporting board;

wherein the first side of the top supporting board and the second side of the top supporting board form a first included angle, and the first included angle is 90 degrees.

2. The resilient cardboard cushion of claim 1, wherein the folded cardboard spring comprises:

a first folded board connected to the first side of the top supporting board; and a second folded board connected between the first folded board and the bottom supporting board.

3. The resilient cardboard cushion of claim 2, further comprising, the slidable supporting foot having a first interference edge; and a second included angle formed between the first interference edge and the second side of the top supporting board;

wherein the first folded board comprises a second interference edge, and a third included angle formed between the second interference edge and the first side of the top supporting board; and wherein a sum of the second included angle and the third included angle is greater than 90 degrees.

4. The resilient cardboard cushion of claim 3, wherein the second included angle is 40.7 degrees to 50 degrees.

5. The resilient cardboard cushion of claim 3, wherein the third included angle is 52 degrees to 62 degrees.

6. The resilient cardboard cushion of claim 3, wherein the first interference edge is configured to touch the second interference edge to slow a compression of the resilient cardboard cushion.

7. The resilient cardboard cushion of claim 3, wherein the second folded board comprises a third interference edge, and a fourth included angle formed between the third interference edge and the bottom supporting board; and wherein the fourth included angle is equal to the third included angle.

8. The resilient cardboard cushion of claim 7, wherein the first interference edge is configured to touch the third interference edge to slow the compression of the resilient cardboard cushion.

9. The resilient cardboard cushion of claim 7, further comprising a circular opening formed in the top supporting board.

10. The resilient cardboard cushion of claim 2, further comprising:

an opening located at a connection area of the top supporting board and the first folded board.

11. The resilient cardboard cushion of claim 1, further comprising:

a slidable protrusion bottom board connected to the slidable supporting foot.

12. The resilient cardboard cushion of claim 11, wherein the bottom supporting board further comprises:

a U-shaped opening, wherein the slidable supporting foot and the slidable protrusion bottom board are slidable in the U-shaped opening.

13. The resilient cardboard cushion of claim 11, further comprising another slidable supporting foot connected to a side opposite to the second side of the top supporting board and another slidable protrusion bottom board connected to another slidable supporting foot.

14. The resilient cardboard cushion of claim 13, wherein when the resilient cardboard cushion is at a first height, the slidable protrusion bottom board is in contact with another slidable protrusion bottom board, and when the resilient cardboard cushion is at a second height greater than the first height, the slidable protrusion bottom board is separated from said another slidable protrusion bottom board.

15. The resilient cardboard cushion of claim 11, wherein a width of the slidable protrusion bottom board is greater than a width at a connection position between the slidable supporting foot and the slidable protrusion bottom board.

16. The resilient cardboard cushion of claim 1, wherein the top supporting board further has a third side opposite to the first side.

17. The resilient cardboard cushion of claim 16, further comprising:

another folded cardboard spring connected to the third side of the top supporting board;

another bottom supporting board connected to another folded cardboard spring;

wherein the slidable supporting foot is configured to be slidably engaged with the bottom supporting board and another bottom supporting board.

* * * * *